US005096333A

United States Patent [19]

Bassett

[11] Patent Number: 5,096,333

[45] Date of Patent: Mar. 17, 1992

[54] FOUNDATION REPAIR METHOD AND APPARATUS

[75] Inventor: Max Bassett, Houston, Tex.

[73] Assignee: Jeanne Bassett, Houston, Tex.

[21] Appl. No.: 515,638

[22] Filed: Apr. 27, 1990

[51] Int. Cl.[5] ..... E02D 5/74

[52] U.S. Cl. ..... 405/244; 405/248; 405/252

[58] Field of Search ..... 405/252, 251, 250, 244, 405/248

[56] References Cited

U.S. PATENT DOCUMENTS

| | | | |
|---|---|---|---|
| 975,488 | 11/1910 | Welsh | 405/252 |
| 1,024,820 | 4/1912 | Bignell | 405/248 |
| 2,342,243 | 2/1944 | Brizay | 405/252 |
| 2,698,520 | 1/1955 | Lloyd | 405/252 |
| 3,625,012 | 12/1971 | Thorburn | 405/252 |
| 4,190,383 | 2/1980 | Pryke et al. | 405/252 |
| 4,426,175 | 1/1984 | Lin | 405/248 X |

*Primary Examiner*—Dennis L. Taylor
*Assistant Examiner*—J. Russell McBee
*Attorney, Agent, or Firm*—Kenneth A. Roddy

[57] ABSTRACT

A method of repairing foundations utilizes precast concrete cylinders which are sequentially driven into the soil and connected by tubular connectors to prevent deflection of the column which forms an underground pier. The tubular connectors maintain the cylindrical members in straight alignment during and after the driving operation and prevent shifting as a result of changing soil conditions. The present method relies upon the skin friction of the precast concrete pier with the soil for its strength. The precast concrete pier may be further strengthened by using hollow cylinders in forming the pier and adding concrete or mud pumped into its center and into the surrounding soil. The soil surrounding the precast concrete pier may be further stabilized and strengthened by pumping a lime, concrete, or mud slurry through the column into the soil surrounding the pile at critical areas where soil shrinkage and shifting often occurs. The present method has the advantage of being faster since the precast concrete cylinders do not have to cure and precasting allows better control of the concrete strength.

21 Claims, 3 Drawing Sheets

FOUNDATION REPAIR METHOD AND APPARATUS

BACKGROUND OF THE INVENTION

1. Field of the Invention

This invention relates generally to foundation repair methods and apparatus, and more particularly to a foundation repair method and apparatus utilizing precast concrete cylinders joined by tubular connectors to create a column which is sequentially driven into the soil to form an underground pier.

2. Brief Description of the Prior Art

There are several conventional methods known for repairing the foundations of buildings having a slab-on-ground foundation.

One of the most common methods of foundation repair comprises the use of drilled underground piers. Holes are drilled to a depth of approximately eight to twelve feet and filled with concrete to a level of approximately twelve inches below the grade beam. The depth of the bottom of the pier is a function of the type of soil and is located below the zone of seasonal moisture change. The bearing surface of the repair pair pier is increased by a bell-shaped bottom configuration. After the concrete has dried, jacks are placed on top of the pier and the foundation is brought to a level position. Blocks, shims, and/or grout are then used to replace the jack. This poured concrete pier method is labor intensive, time consuming, and expensive.

A more recent method of repairing foundations is with the use of driven precast concrete piles. In this method, a plurality of precast solid concrete cylindrical pile members approximately one foot in length and six inches in diameter are driven into the ground one on top of the other to form a column of the stacked concrete cylinders. One or more larger diameter cylindrical concrete members and/or concrete blocks at the top of the stacked column form the pile cap. Jacks are placed on top of the pile cap and the foundation is brought to a level position. Blocks, shims, and/or grout are then used to replace the jack. The precast concrete pile method relies upon the skin friction with the soil for its strength. It has the advantage of being faster since the concrete does not have to cure and precasting allows better control of the concrete strength. A major disadvantage is that the one foot cylindrical sections may shift and become misaligned during or after the driving operation.

Another common technique of stabilizing soil beneath a foundation is to provide a partial moisture barrier by injecting a lime slurry under pressure into the soil around the edge and beneath the grade beam until the lime is rejected by the soil. The lime tends to increase the moisture content around the critical perimeter area where soil shrinkage has occurred. Although some restoration may occur, this technique does not necessarily return the foundation to its original level position.

The present invention is distinguished over the prior art in general, by a method of repairing foundations utilizing precast concrete cylinders connected by tubular connectors to create a column which is sequentially driven into the soil to form an underground pier. The tubular connectors maintain the cylindrical members in straight alignment during and after the driving operation and prevent shifting as a result of changing soil conditions. The present method relies upon the skin friction of the precast concrete pier with the soil for its strength and the precast concrete pier thus formed may be further strengthened by using hollow concrete cylinders and adding concrete or mud pumped into its center and into the surrounding soil. The soil surrounding the precast concrete pier may be further stabilized and strengthened by pumping a lime, concrete, or mud slurry through the column into the soil surrounding the pile at critical areas where soil shrinkage and shifting often occurs. The present method has the advantage of being faster since the precast concrete cylinders do not have to cure and precasting allows better control of the concrete strength.

SUMMARY OF THE INVENTION

It is therefore an object of the present invention to provide a method of foundation repair utilizing hollow or solid precast concrete cylinders connected by tubular connectors to form underground piers.

It is another object of this invention to provide a method of foundation repair utilizing hollow or solid precast concrete cylinders connected by tubular connectors to form underground piers wherein the soil surrounding the pier is stabilized.

Another object of this invention is to provide a method of foundation repair utilizing hollow or solid precast concrete cylinders connected by tubular connectors to form underground piers wherein the critical area where soil shrinkage and shifting occurs above the bottom of the column is stabilized.

Another object of this invention is to provide a method of foundation repair utilizing hollow or solid precast concrete cylinders connected by tubular connectors which relies upon the skin friction of the precast concrete column with the soil for its strength and the tubular connectors maintain the cylindrical members in straight alignment during and after the driving operation and prevent shifting as a result of changing soil conditions.

Another object of this invention is to provide a method of foundation repair utilizing hollow or solid precast concrete cylinders connected by tubular connectors to form underground piers which does not require extensive labor or time.

A further object of this invention is to provide a method of foundation repair utilizing hollow or solid precast concrete cylinders connected by tubular connectors to form underground piers which is quickly completed since the precast concrete cylinders do not have to cure and precasting allows better control of the concrete strength.

A further object of the present invention to provide a method of foundation repair utilizing hollow precast concrete cylinders connected by tubular connectors to form hollow underground piers through which lime, concrete, or mud slurry may be pumped into the soil surrounding the pile at critical areas where soil shrinkage and shifting often occurs.

A further object of the present invention to provide a method of foundation repair utilizing hollow precast concrete cylinders connected by tubular connectors to form hollow underground piers wherein the soil surrounding the pier is stabilized and through which lime, concrete, or mud slurry may be pumped into the soil surrounding the pile at critical areas where soil shrinkage and shifting often occurs.

A further object of this invention is to provide a method of foundation repair utilizing hollow precast concrete cylinders connected by tubular connectors to form underground piers wherein the critical area where soil shrinkage and shifting occurs above the bottom of the column is stabilized and through which lime, concrete, or mud slurry may be pumped into the soil surrounding the pile at critical areas where soil shrinkage and shifting often occurs.

Still another object of this invention is to provide a method of foundation repair utilizing hollow precast concrete cylinders connected by tubular connectors which relies upon the skin friction of the precast concrete column with the soil for its strength and the tubular connectors maintain the cylindrical members in straight alignment during and after the driving operation and prevent shifting as a result of changing soil conditions and through which lime, concrete, or mud slurry may be pumped into the soil surrounding the pile at critical areas where soil shrinkage and shifting often occurs.

Still another object of this invention is to provide a method of foundation repair utilizing hollow precast concrete cylinders connected by tubular connectors to form underground piers through which lime, concrete, or mud slurry may be pumped into the soil surrounding the pile at critical areas where soil shrinkage and shifting often occurs and which does not require extensive labor or time.

Still a further object of this invention is to provide a method of foundation repair utilizing hollow precast concrete cylinders connected by tubular connectors to form underground piers through which lime, concrete, or mud slurry may be pumped into the soil surrounding the pile at critical areas where soil shrinkage and shifting often occurs and which is quickly completed since the precast concrete cylinders do not have to cure and precasting allows better control of the concrete strength.

A still further object of this invention is to provide apparatus to be used in the repair of foundations which is simple on construction, economical to manufacture and install and is strong and reliable in use.

Other objects of the invention will become apparent from time to time throughout the specification and claims as hereinafter related.

The above noted objects and other objects of the invention are accomplished by a method of repairing foundations utilizing hollow precast concrete cylinders connected by tubular connectors to create a column which is sequentially driven into the soil to form an underground pier. The tubular connectors maintain the cylindrical members in straight alignment during and after the driving operation and prevent shifting as a result of changing soil conditions. The present method relies upon the skin friction of the precast concrete pier with the soil for its strength Where hollow cylinders are used, the precast concrete pier thus formed may be further strengthened by the addition of concrete or mud pumped into its center and into the surrounding soil. The soil surrounding the precast concrete pier may be further stabilized and strengthened by pumping a lime, concrete, or mud slurry through the column into the soil surrounding the pile at critical areas where soil shrinkage and shifting often occurs. The present method has the advantage of being faster since the precast concrete cylinders do not have to cure and precasting allows better control of the concrete strength.

DESCRIPTION OF THE PREFERRED EMBODIMENT

Figures 1, 2, 3, 4:
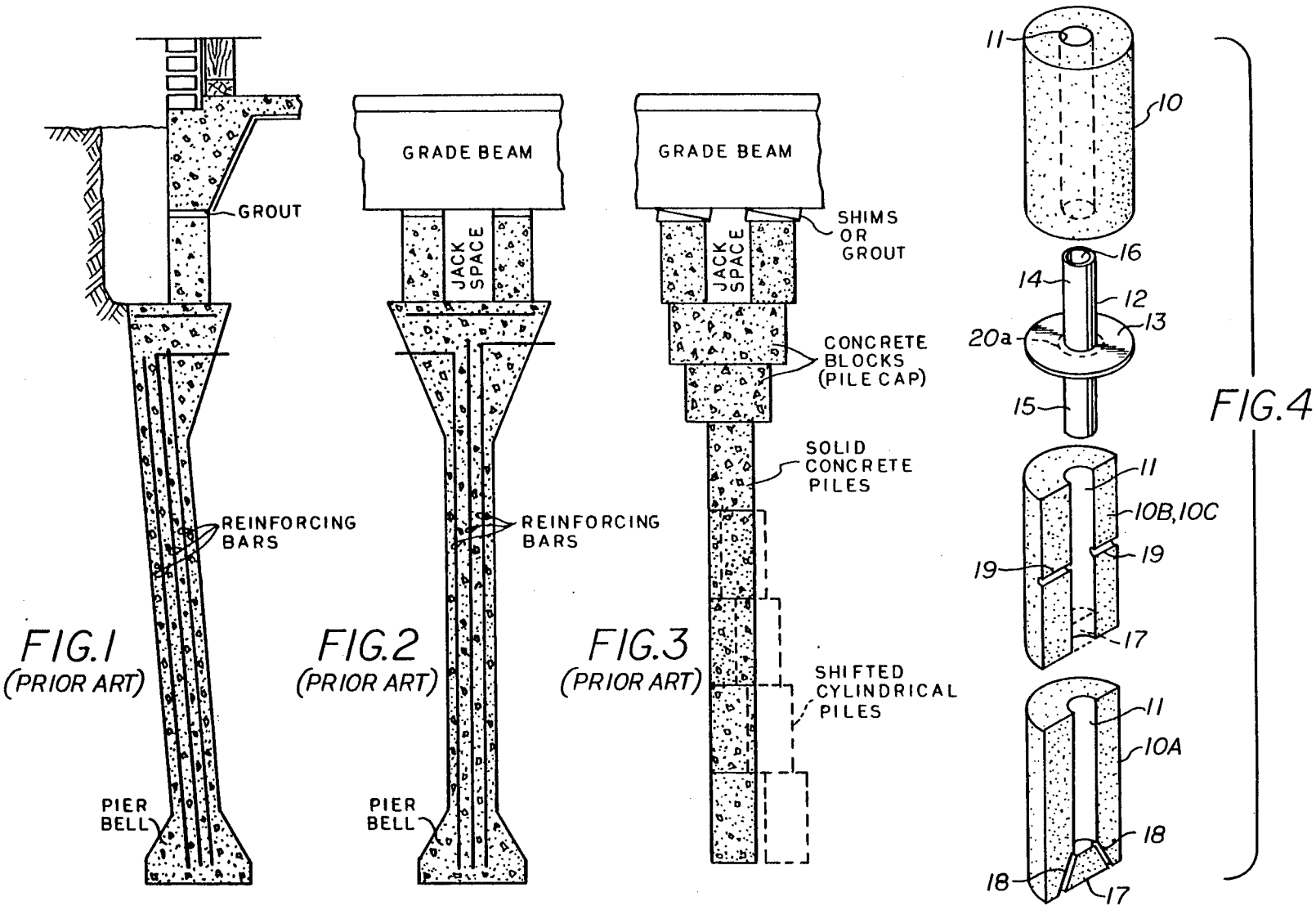
FIG. 3 (PRIOR ART)
FIG. 2 (PRIOR ART)
FIG. 1 (PRIOR ART)
FIG. 1 is a longitudinal cross section of a prior art method of foundation repair using drilled underground piers shown from the side.
FIG. 2 is a longitudinal cross section of the prior art method of FIG. 1 shown from the front.
FIG. 3 is a longitudinal cross section of another prior art method of foundation repair using solid precast concrete cylinders to form underground piers.
FIG. 4 is an exploded isometric illustrating the apparatus used in the present method of foundation repair in accordance with the present invention.

Referring to the drawings by numerals of reference, there is shown in FIGS. 1, 2, and 3, two prior art methods of repairing the foundations of buildings having a slab-on-ground foundation.

FIGS. 1 and 2 show a common prior art method of foundation repair using drilled underground piers. Holes are drilled to a depth of approximately eight to twelve feet Steel reinforcing bars are placed in the holes and the holes are filled with concrete to a level of approximately twelve inches below the grade beam. The depth of the bottom of the pier is a function of the type of soil and is located below the zone of seasonal moisture change. The bearing surface of the repair pier is increased by providing a bell-shaped bottom configuration. After the concrete has dried, jacks are placed on top of the pier and the foundation is brought to a level position. Blocks, shims, and/or grout are then used to replace the jack. The poured concrete pier method is labor intensive, time consuming, and expensive.

FIG. 3 shows a more recent prior method of foundation repair which utilizes driven precast concrete piles. In this method, a plurality of precast solid concrete cylindrical pile members approximately one foot in length and six inches in diameter are driven into the ground one on top of the other to form a column of the stacked concrete cylinders. One or more larger diameter cylindrical concrete members and/or concrete blocks at the top of the stacked column form the pile cap. Jacks are placed on top of the pile cap and the foundation is brought to a level position. Blocks, shims, and/or grout are then used to replace the jack. The precast concrete pile method relies upon the skin friction with the soil for its strength. However, as illustrated in dotted line, a major disadvantage of this method is that the one foot cylindrical sections may shift and become misaligned during or after the driving operation or as a result of shifting soil conditions.

FIG. 4 illustrates the apparatus used in a preferred embodiment of the present method of foundation repair. In the present method, a plurality of precast concrete cylindrical pile members having a central longitudinal hole extending therethrough are used. The hollow cylindrical pile members 10 are approximately 1 foot in length and 6 inches in diameter. The central longitudinal hole 11 extending through the cylindrical members is approximately 1 3/8" to 1 ½" in diameter. A plurality of metal tubular connectors 12 are provided each of which has a radial flange 13 approximately 6" in diameter and ⅛" thick intermediate the ends with tubular portions 14 and 15 at the top and bottom respectively of the flange 13. A longitudinal bore 16 extends through the connector 12 and the exterior diameter of the tubular portions 14 and 15 are sized to be slidably received within the central hole 11 of the cylindrical pile members 10. The tubular portions 14 and 15 are shorter than the depth of the central hole 11 such that when they are placed between stacked cylindrical members, they extend a distance into the ends of the cylindrical members and leave a longitudinal portion of the central hole 11 exposed. They may also be of sufficient length to abut one another at the center of the cylindrical concrete members.

In some applications, described hereinafter, a lowermost cylindrical concrete member 10A may be used in which the longitudinal hole 11 does not extend completely through but terminates a distance above the bottom of the cylindrical member to form an enclosed bottom end 17. A plurality of circumferentially spaced holes 18 extend radially outward and downward from the bottom of the central hole 11 to the exterior of the cylindrical pile member 10A.

Other applications may use one or more cylindrical members 10B which have a longitudinal hole 11 extending therethrough, but also have a plurality of circumferentially spaced holes 19 extending radially outward from the interior of the central hole 11 to the exterior of the cylindrical pile member 10B. Similarly, a lowermost cylindrical 10C may be provided which has a plurality of radially extending holes 19 but in which longitudinal hole 11 terminates a distance above the bottom of the cylindrical member to form an enclosed bottom end 17 as indicated in dotted line Suitable seals **20*a* may also be placed on the exterior of the tubular portions 14 and 15 of the tubular connectors 12 to reside adjacent the top and bottom surfaces of the flange 13 and surround the tubular portions to form a fluid seal at the top and/or bottom of the central holes 11** of the cylindrical members.

Figure 5:
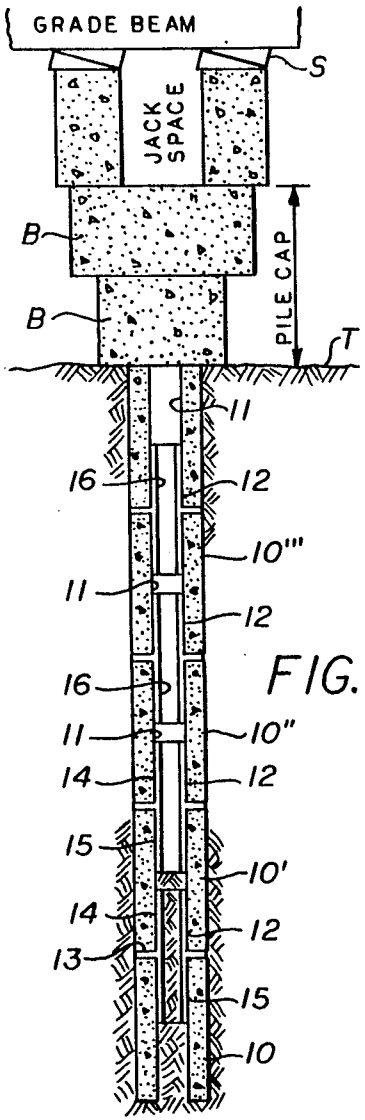
FIG. 5 is a longitudinal cross section of a preferred method of foundation repair using hollow precast concrete cylinders connected by tubular connectors to form underground piers.

In the present method of repair (FIG. 5) a trench T is dug beneath the grade beam of the foundation. A first concrete cylinder 10 is placed in the proper location in the trench below the grade beam and a metal plate, approximately 3" thick, is placed on top of the cylinder. The cylinder 10 is then driven into the ground by conventional jacking apparatus placed between the grade beam and the metal plate. The jack and the metal plate are removed and a tubular connector 12 is placed on top of the first cylinder 10 with its lower tubular portion 15 received within the hole 11 of the first cylinder and its flange 13 bearing in the top surface of the cylinder. A second cylinder 10' is placed on top of the tubular connector 12 with its hole 11 received on the upstanding tubular portion 14 and its bottom surface bearing on the top surface of the flange 13.

The metal plate and jack are reinstalled and the first and second cylinders are then driven as a unit into the ground by the jacking apparatus. This process continues with the precast cylinders stacked one on top of the other with a tubular connector between each one to sequentially form a column of the stacked concrete cylinders. The column is driven into the ground until refusal. The tubular connectors 12 maintain the concrete cylinders in alignment and prevent them from shifting as they are driven.

After the column has been driven to refusal, one or more larger diameter cylindrical concrete members and/or concrete blocks B are placed on top of the stacked column form the pile cap. Jacks are placed on top of the pile cap and the foundation is brought to a level position. Blocks, shims, and/or grout S are then used to replace the jack.

This basic method relies upon the skin friction of the inside and outside diameters of the precast concrete column with the soil for its strength and the tubular connectors 12 maintain the cylindrical members in straight alignment during and after the driving operation and prevent shifting as a result of changing soil conditions. However, there are several preferred methods of further strengthening the column and stabilizing the soil surrounding the column which may be incorporated prior to placing of the pile cap.

A conduit may be inserted into the interior of the column and water pumped therethrough to flush out the soil in the interior of the column. A concrete, mud, or adhesive slurry may then be pumped into the center of the column to further reinforce and strengthen the structure.

Figure 6:
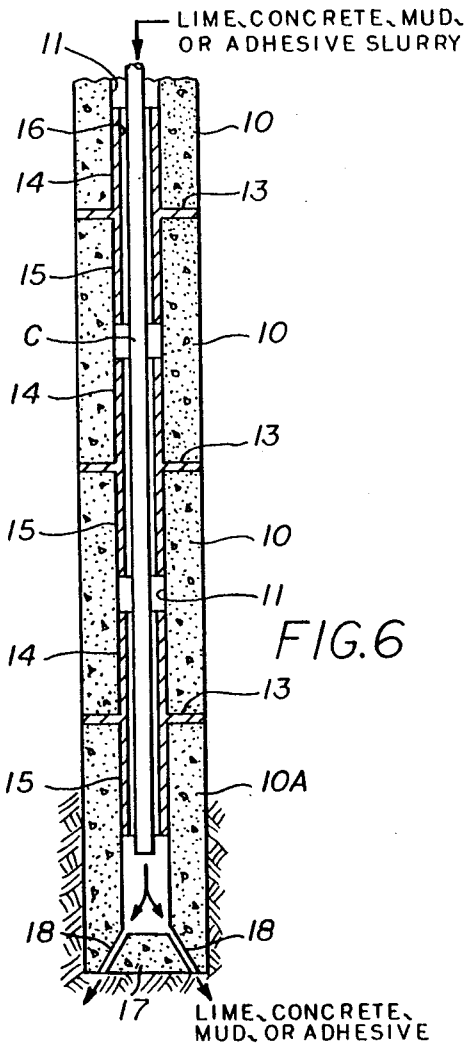
FIG. 6 is a longitudinal cross section of a preferred method of foundation repair using hollow precast concrete cylinders connected by tubular connectors to form underground piers wherein the soil surrounding the pier is stabilized.

As shown in FIG. 6, in some applications the cylindrical member 10A having an enclosed bottom end 17 may be used as the first or lowermost cylindrical member in the column. After the column has been driven, a conduit C is inserted through the holes 11 and 16 of the cylindrical members 10, 10A and tubular connectors 12, respectively, with its bottom end just above the bottom wall 17 of the lowermost cylindrical member 10A. A lime slurry is then pumped through the conduit C and flows through the plurality of circumferentially spaced holes 18 in the cylinder 10A and radially outward and downward to migrate through the soil surrounding the bottom of the column.

The lime slurry forms a partial moisture barrier and stabilizes the soil by increasing its moisture content in the perimeter of the column. Alternatively, concrete, mud, or adhesive material may be pumped through the conduit to stabilize the soil.

The critical area where soil shrinkage and shifting occurs is often above the bottom of the column. In order to stabilize this area, a cylindrical member 10C having an enclosed bottom end and radially extending holes 19 and one or more of the cylindrical members 10B having a longitudinal hole 11 therethrough and a plurality of circumferentially spaced holes 19 extending radially outward from the interior of the central hole 11 to the exterior of the cylindrical member 10B may be used.

Figure 7:
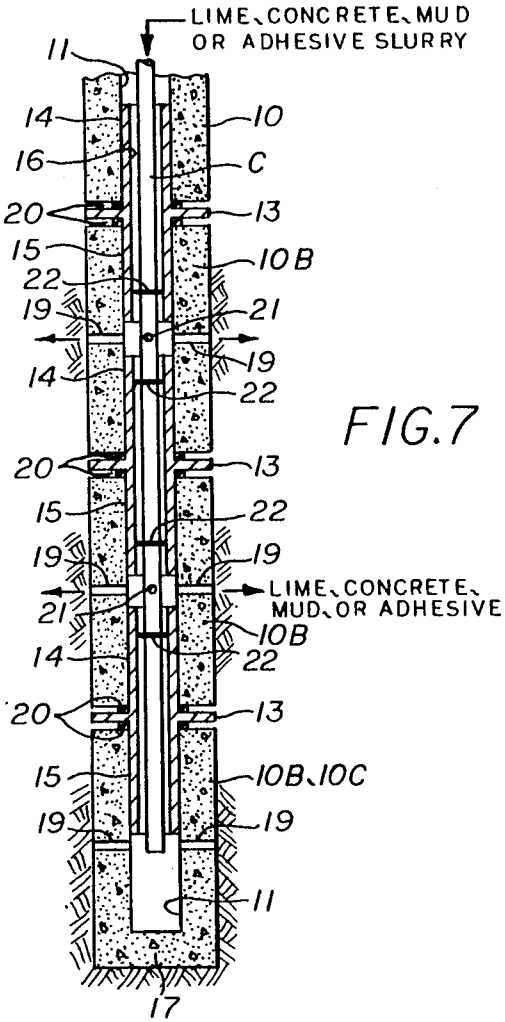
FIG. 7 is a longitudinal cross section of a preferred method of foundation repair using hollow precast concrete cylinders connected by tubular connectors to form underground piers wherein the critical area where soil shrinkage and shifting occurs above the bottom of the column is stabilized.

As seen in FIG. 7, the cylindrical member 10C would serve as the lowermost member and the cylindrical members 10B would be selectively stacked in the column during the driving operation at predetermined heights above the bottom cylindrical member. In this application, suitable seals 20 are placed on the exterior of the tubular portions 14 and 15 of the tubular connectors 12 to reside adjacent the top and bottom surfaces of the flange 13 and surround the tubular portions to form a fluid seal at the top and/or bottom of the central holes 11 of the cylindrical members.

The conduit C used in this application would have an enclosed bottom and outlets 21 through its side wall with exterior seals 22 above and below the outlets to form a fluid seal on the interior of the hole 16 in the tubular connector 12. After the column has been driven, the conduit C is inserted through the holes 11 and 16 of the cylindrical members 10B and tubular connectors 12, respectively, with its outlets 21 aligned with the holes 19 and its seals 22 forming a fluid seal thereabove and below. The lime, concrete, mud, or adhesive slurry is then pumped through the conduit C and flows through the plurality of circumferentially spaced holes 19 to stabilize the soil at the area or areas where soil shrinkage and shifting occurs.

Referring again to FIGS. 6 and 7, a conduit may also be connected to the intake of a pump and inserted into the interior of the column to pump water out of the interior of the column in the event that seepage occurs through the holes in the concrete members or through the point of connection with the tubular connectors. Utilizing the isolated holes and sealed conduit described in FIG. 7, water could also be drawn from the soil in the periphery of the holes.

Figure 8:
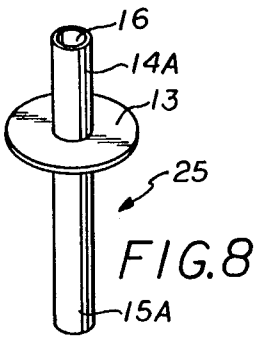
FIGS. 8, 9, and 10 show a modification of the tubular connector used in the present method which has tubular portions of unequal length.
Figure 10:
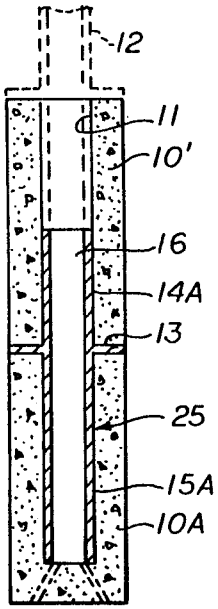
Figure 9:
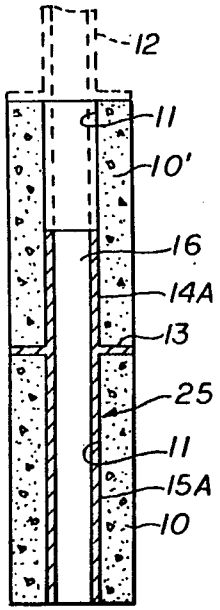

FIGS. 8, 9, and 10 show a modification of the tubular connector used in the present method. The modified connector 25 has a radial flange 13 approximately 6" in diameter and ⅛" thick intermediate the ends with tubular portions 14A and 15A at the top and bottom respectively of the flange 13 and a longitudinal bore 16. The bottom tubular portion 15A is longer than the top tubular portion 14A such that the bottom portion 15A will extend to the bottom of the cylindrical member 10 or will abut the bottom of the cylinder 10A having an enclosed end. The top tubular portion 14A is of such length to extend to the center of the cylindrical 10' placed thereon. The tubular portions of subsequent connectors 12 as previously described would be of equal length and sized to extend to the center of the upper and lower cylindrical members between which they are installed. In this manner, rather than leaving a longitudinal portion of the central hole 11 exposed, the top and bottom ends of the connectors will abut at the center of the concrete members. Thus, the stacked connectors will form an interior load bearing column.

Figure 11:
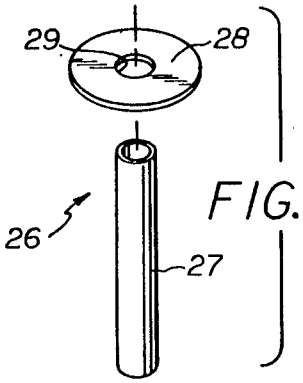
FIGS. 11 and 12 show an alternate tubular connector which may be used in the present method which has a flat disk-like flange formed of resilient material
Figure 12:
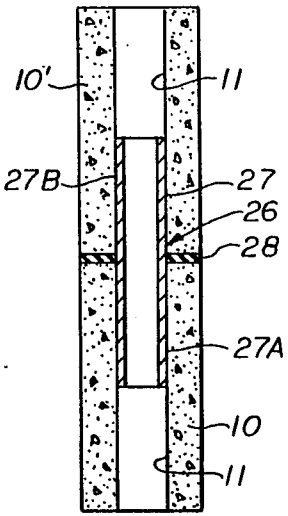

FIGS. 11 and 12 show an alternate tubular connector 26 which may be used in the present method The alternate connector 26 comprises a metal tubular member 27 and a flat disk-like flange 28 formed of resilient material having a hole 29 through its center which is slidably received in the outside diameter of the tubular member 27 and is frictionally engaged thereon approximately midway between the ends of the tubular member. As seen in FIG. 12, when the flange 28 is installed on the tubular member 27, the connector 26 is placed on top of one cylinder 10 with the lower portion 27A of the tubular member 27 received within the hole 11 of the lower cylinder and its resilient flange 28 bearing in the top surface of the cylinder. A second cylinder 10' is placed on top of the tubular connector 26 with its hole 11 received on the upper portion 27B of the tubular member 27 and its bottom surface bearing on the top surface of the resilient flange 28.

The tubular connector 26 eliminates the need to provide seals on the exterior of the tubular portions of the previously described connectors 12, since the resilient flange 28 surrounds the tubular member 27 and forms a fluid seal on the exterior of the tubular member and at the top and bottom of the central holes 11 of the cylindrical members.

Figure 13:
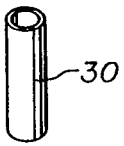
FIGS. 13, 14, and 15 show a tubular lower driving member which may be used in combination with the tubular connector members.

FIG. 13 shows a tubular lower driving member 30 which may be used in combination with the tubular connectors 26 having a resilient flange to facilitate the driving operation. The tubular lower driving member 30 is a hollow tubular metal member having substantially the same interior and exterior diameters as the tubular connector member 27, but is shorter in length than the connector.

Figure 15:
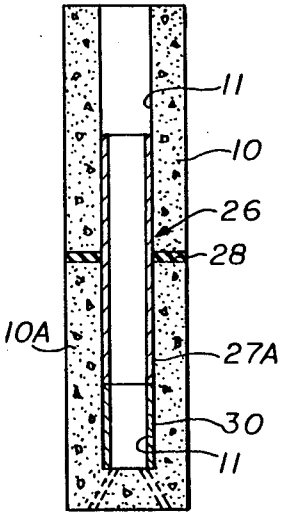
Figure 14:
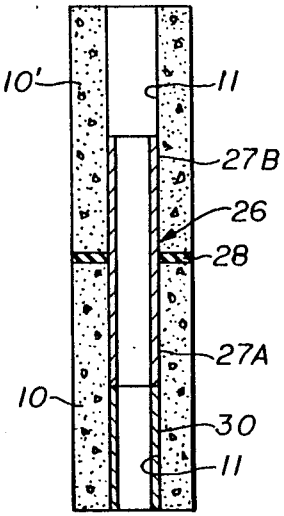

As seen in FIGS. 14 and 15, the driving member 30 may be installed at the bottom of the central hole 11 of an open ended concrete cylindrical member 10, or a concrete cylinder 10A of the type having an enclosed bottom. The driving member 30 then serves as a load bearing spacer. For example, if the concrete cylinders are 12" long, and the connectors are 12" long, a driving member 6" long would be installed at the bottom of the hole 11 of the lowermost concrete cylinder. When the first connector is installed, its bottom end will abut the top of the driving member. This will position the first and subsequent connectors such that their ends will abut at the center of the concrete members.

Figure 16:
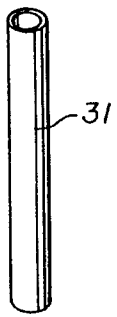

FIG. 16 shows an elongate lower tubular connector member 31 which can be used with the resilient flange 28 to facilitate the driving operation. The lower tubular connector member 31 is a hollow tubular metal member having substantially the same interior and exterior diameters as the previously described tubular connectors, but is longer.

Figure 17:
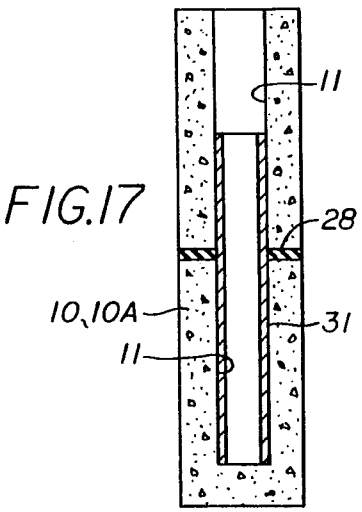
FIGS. 16 and 17 show an elongate lower tubular connector member which can be used with a resilient flange to facilitate the driving operation.

As seen in FIG. 17, the elongate tubular connector member 31 may be installed at the bottom of the central hole 11 of an open ended concrete cylindrical member 10, or a concrete cylinder 10A of the type having an enclosed bottom. The elongate tubular connector member 31 then serves as a load bearing spacer. For example, if the concrete cylinders are 12" long, and the subsequent connectors are 12" long, an elongate tubular connector member 18" long would be installed at the bottom of the hole 11 of the lowermost concrete cylinder. When the first shorter connector is installed, its bottom end will abut the top of the elongate connector 31. This will position the subsequent shorter connectors such that their ends are at the center of the concrete members.

A still further embodiment of the invention utilizes solid concrete cylinders, as shown in FIG. 3, with external guide sleeves surrounding the joint between successive cylinders to prevent sidewise migration of the pile as it is driven into the ground. Alternatively, solid cylinders can be used with indentations or holes extending only partially therein which can receive a short tie rod to secure the cylinders together and prevent sidewise migration during pile driving. This embodiment holds the sections of the pile in line but does not have the advantage of the hollow cylinders in allowing for circulation of liquid or slurry along the length of the pile.

Thus, the present concrete pile methods rely upon the skin friction of the precast concrete column with the soil for its strength and the tubular connectors maintain the cylindrical members in straight alignment during and after the driving operation and prevent shifting as a result of changing soil conditions. The precast concrete pile thus formed may be further strengthened by the addition of concrete or mud pumped into its center and into the surrounding soil. The soil surrounding the precast concrete pile may be stabilized and further strengthened by pumping a lime, concrete, mud, or adhesive slurry through the column into the soil surrounding the pile at critical areas where soil shrinkage and shifting often occurs. The present method also has the advantage of being faster since the precast concrete cylinders do not have to cure and precasting allows better control of the concrete strength.

While this invention has been described fully and completely with special emphasis upon several preferred methods and embodiments, it should be understood that within the scope of the appended claims the invention may be practiced otherwise than as specifically described herein.

I claim:

1. A method of installing concrete piling comprising the steps of;

providing a plurality of generally cylindrical precast concrete members having an aperture extending longitudinally through the center thereof, providing a plurality of generally tubular connector members having central upper and lower tubular portions and a central aperture extending longitudinally through the center thereof, placing a first concrete member in position to be driven into the ground, driving said first concrete member into the ground, installing the lower tubular portion of a first one of said connectors into the central aperture of said first concrete member with the upper tubular portion of said connector extending upwardly therefrom, placing a second concrete member atop said first concrete member with its central aperture received on the upper tubular portion of said first connector to connect said concrete members and prevent lateral movement between the connected concrete members, driving the connected first and second concrete members as a unit into the ground without lateral displacement, installing the lower tubular portion of another connector member into the central aperture of the uppermost driven concrete member with the upper tubular portion of said another connector extending upwardly therefrom, placing another concrete member atop the uppermost driven concrete member with its central aperture received on the upper tubular portion of said another connector member to connect said concrete members and prevent lateral movement between the connected concrete members, driving the connected concrete members as a unit into the ground, and repeating the steps of installing, placing and driving subsequent ones of said concrete members and connectors to sequentially drive a column of sequentially connected concrete members into the ground until it reaches the point of refusal by the ground.

2. A method of repairing foundations of the type having an existing grade beam comprising the steps of;

providing a plurality of generally cylindrical precast concrete members having an aperture extending longitudinally through the center thereof, providing a plurality of generally tubular connector members having central upper and lower tubular portions and a central aperture extending longitudinally through the center thereof, digging a trench beneath the existing grade beam of the foundation, placing a first concrete member in the trench below the grade beam, driving said first concrete member into the ground, installing the lower tubular portion of a first one of said connector members into the central aperture of said first concrete member with the upper tubular portion of said first connector extending upwardly therefrom, placing a second concrete member atop said first concrete member with its central aperture received on the upper tubular portion of said first connector member to connect said concrete members and prevent lateral movement between the connected concrete members, driving the connected first and second concrete members as a unit into the ground without lateral displacement, installing the lower tubular portion of another connector member into the central aperture of the uppermost driven concrete member with the upper tubular portion of said another connector extending upwardly therefrom, placing another concrete member atop said uppermost driven concrete member with its central aperture received on the upper tubular portion of said another concrete member to connect said concrete members and prevent lateral movement between the connected concrete members, driving the connected concrete members as a unit into the ground, and repeating the steps of installing, placing and driving subsequent ones of said concrete members and connectors to sequentially drive a column of sequentially connected concrete members into the ground until it reaches the point of refusal by the ground, said sequentially driven column of said sequentially connected concrete members and said connector members having a central longitudinal aperture, providing at least one concrete block member and placing it on top of the driven column of said cylindrical concrete members to form a pile cap and leaving a jack space between the top of the pile cap and the bottom of the existing grade beam, providing a jack and placing it in the jack space between the top of the pile cap the bottom of the existing grade beam and jacking the grade beam to a level position, providing supportive fill materials and after reaching the level position, placing said supportive fill materials between the top of the pile cap and the bottom of the grade beam, and thereafter removing said jack and filling in said trench with soil.

3. The method according to claim 2 including the steps of;

after driving the column of said sequentially connected concrete members into the ground until reaching the point of refusal and prior to placing said at least one concrete block member on top of the driven column to form a pile cap, filling the central longitudinal aperture of said sequentially driven column with concrete and allowing it to harden and cure.

4. The method according to claim 2 including the steps of;

after driving the column of said sequentially connected concrete members into the ground until reaching the point of refusal and prior to placing said at least one concrete block member on top of the driven column to form a pile cap, filling the central longitudinal aperture of said sequentially driven column with mud and allowing it to harden.

5. The method according to claim 2 in which at least one of said plurality of generally cylindrical precast concrete members has a central aperture extending longitudinally from its top end and an enclosed bottom end and a plurality of spaced holes extending outward and downward through the enclosed bottom end from the bottom of the central aperture to the exterior of the cylindrical member, said cylindrical member having an enclosed bottom end being said first concrete member to be driven into the ground, and said cylindrical members having an aperture extending longitudinally through the center thereof serving as said second, said another, and said subsequent concrete members, and including the steps of:

after driving the column of said sequentially connected concrete members into the ground until reaching the point of refusal and prior to placing said at least one concrete block member on top of the driven column form a pile cap, providing a conduit and inserting it through the longitudinal aperture of the sequentially driven column with its bottom end at the enclosed bottom end of the central aperture of the lowermost said cylindrical concrete member, pumping a soil stabilizing slurry through the conduit such that it flows through the plurality of circumferentially spaced holes in said lowermost cylindrical member to migrate through the soil surrounding the bottom of the driven column to stabilize the soil in the perimeter of the column, and thereafter removing the conduit.

6. The method according to claim 2 in which at least one of said plurality of generally cylindrical precast concrete members has a central aperture extending longitudinally from its top end and an enclosed bottom end to serve as said first concrete member to be driven into the ground, said generally cylindrical precast concrete members having an aperture extending longitudinally through the center thereof serving as intermediate concrete members, some of said plurality of generally cylindrical precast concrete members have an aperture extending longitudinally through the center thereof and a plurality of circumferentially spaced holes extending radially outward through their side wall from the longitudinal aperture to the exterior of the cylindrical member to serve as fluid effusion concrete members, and including the steps of;

providing seal means on said connector members positioned intermediate their upper and lower tubular portions to be received between two said cylindrical concrete members and form a fluid tight seal at the upper and lower ends of the central aperture of said concrete members when received and engaged therebetween to prevent fluid from flowing from the interior of the central aperture at the top and bottom ends of said connected concrete members.

7. The method according to claim 6 including the steps of;

providing an elongate tubular conduit having apertures through its side wall at predetermined longitudinal locations and seal means on its exterior above and below said apertures, determining the location of soil areas beneath the existing grade beam which are subject to soil shrinkage and shifting and the location at which said fluid effusion concrete members are to be placed relative thereto, and after driving said first concrete member into the ground and installing a first said connector on said first concrete member, said steps of connecting said second, said another, and said subsequent concrete members comprise;

connecting either a said intermediate concrete member or a said fluid effusion concrete member atop said first concrete member in axial alignment with said connector member engaged therebetween, driving said sequentially connected concrete members as a unit into the ground, installing another connector member on the uppermost driven concrete member, connecting another said intermediate or said fluid effusion concrete member with the uppermost concrete member with said another connector member engaged therebetween, driving said connected concrete members as a unit into the ground, and repeating this step with subsequent selected concrete members and connectors to drive a column of sequentially connected concrete members into the ground until it reaches refusal by the ground with said fluid effusion concrete members spaced longitudinally in the driven column to be positioned at the general location of soil areas beneath the existing grade beam which are subject to soil shrinkage and shifting, inserting said apertured conduit through the longitudinal apertures of the sequentially driven column and positioning it such that its apertures are adjacent the radial holes of said fluid effusion concrete members and its seal means form a fluid seal on the interior of the central aperture of said connectors above and below the radial holes of said fluid effusion concrete members, whereby an isolated fluid flow path is established between the conduit apertures and said fluid effusion concrete member radial holes by the connector seal means at the upper and lower ends of said fluid effusion concrete member and the conduit seal means above and below the conduit apertures, pumping a soil stabilizing slurry through the apertured conduit such that it flows through said conduit apertures and the radial holes of said fluid effusion concrete member to migrate through the soil surrounding said fluid effusion concrete members int he driven column to stabilize the soil in the perimeter of the driven column at predetermined longitudinal locations and thereafter removing said conduit.

8. The method according to claim 7 including the steps of;

after removing said apertured conduit and prior to placing said at least one concrete block member on top of said driven column to form a pile cap, filling the central longitudinal aperture of said sequentially driven column with concrete and allowing it to harden and cure.

9. The method according to claim 7 including the steps of;

after removing said apertured conduit and prior to placing said at least one concrete block member on top of the driven column to form a pile cap, filling the central longitudinal aperture of said sequentially driven column with mud and allowing it to harden.

10. The method according to claim 2 in which at least one of said plurality of generally cylindrical precast concrete members has a longitudinal central aperture extending from its top end and an enclosed bottom end to serve as said first driven cylindrical concrete member, and the upper and lower tubular portions of said connector members are of a predetermined length such that the ends of said installed connector members meet inside said central longitudinal aperture of said driven column to for a continuous lining and an interior load bearing column.

11. A precast concrete pier assembly for use in supporting the existing grade beam of a foundation comprising;

a column formed of a plurality of stacked generally cylindrical precast concrete members having an aperture extending longitudinally through the center thereof, and a plurality of tubular connector members having coaxial upper and lower tubular portions and a central aperture of substantially constant inner diameter, said aperture extending longitudinally through the center thereof received and engaged between said stacked concrete members to secure said concrete members in axial alignment and prevent lateral relative movement therebetween, said concrete members and said connector members adapted to be individually stacked and connected in axial alignment and sequentially driven into the ground to form a unitary column.

12. A precast concrete pier assembly according to claim 11 in which each said connector member received between said stacked concrete members with its lower tubular portion received within the central aperture at the top of a lower said concrete member and its upper portion received in the central aperture at the bottom of an upper said concrete member, whereby said unitary column formed by said concrete members and said connector members has a central longitudinal aperture.

13. A precast concrete pier assembly according to claim 12 in which the lowermost said cylindrical precast concrete member has an enclosed bottom end and a plurality of circumferentially spaced holes extending outward and downward from the bottom of the central longitudinal aperture to the exterior of the cylindrical member, whereby a soil stabilizing slurry may be pumped through a conduit inserted into the central longitudinal aperture of said driven column to flow through the plurality of circumferentially spaced holes in the lowermost cylindrical member to migrate through the soil surrounding the bottom of the column and stabilize the soil in the perimeter of the driven column.

14. A precast concrete pier assembly according to claim 12 in which said connector members each has a radially extending circumferential flange on its exterior separating said upper tubular portion and said lower tubular portion, said flange received between the top end of a lower concrete member and the bottom end of an upper concrete member.

15. A precast concrete pier assembly according to claim 14 in which said flange is formed of resilient material and forms a fluid tight seal between the exterior of said tubular connector member and the upper and lower ends of the central aperture of said concrete members when received and engaged therebetween.

16. A precast concrete pier assembly according to claim 15 in which said resilient flange is removably received on the exterior of said tubular connector member.

17. A precast concrete pier assembly according to claim 14 including seal means on said connector members positioned adjacent said flange to form a fluid tight seal between the exterior of said tubular connector member and the upper and lower ends of the central aperture of said concrete members when received and engaged therebetween.

18. A precast concrete pier assembly according to claim 12 in which the lowermost said cylindrical precast concrete member has an enclosed bottom end and the cylindrical precast concrete members connected thereabove have an aperture extending longitudinally through the center thereof, whereby said unitary column formed by said concrete members and said connector members has a central longitudinal aperture and an enclosed bottom.

19. A precast concrete pier assembly according to claim 18 in which the central longitudinal aperture of said formed unitary column is substantially filled with materials to strengthen the column structure.

20. A precast concrete pier assembly according to claim 18 in which the lowermost said cylindrical precast concrete member has an enclosed bottom end, the cylindrical precast concrete members connected thereabove have an aperture extending longitudinally through the center thereof, predetermined ones of said concrete members connected thereabove have a plurality of circumferentially spaced holes extending radially outward through their side wall from the central longitudinal aperture to the exterior of the cylindrical member, said predetermined ones of said concrete members being positioned longitudinally in said column at selective locations above the bottom of the column at the general location of soil areas which are subject to soil shrinkage and shifting, whereby a soil stabilizing slurry may be pumped through a conduit inserted into the central longitudinal aperture of said driven column to flow through the plurality of circumferentially spaced holes in said predetermined ones of said concrete members to migrate through the soil surrounding the column and stabilize the soil in the perimeter of the driven column at said locations.

21. A precast concrete pier assembly according to claim 12 in which said connector members are generally tubular members having upper and lower tubular portions and a central aperture coaxial with the longitudinal aperture of said concrete members when received therebetween, and said tubular portions are of a predetermined length such that the ends thereof meet inside said central longitudinal aperture, which is continuously lined thereby.

* * * * *